United States Patent [19]

Schaller et al.

[11] 3,983,691

[45] Oct. 5, 1976

[54] WINDING AND SETTING MECHANISM FOR WATCH MOVEMENTS

[75] Inventors: Kurt Schaller, Lengnau; Daniel Rochat, St-Blaise, both of Switzerland

[73] Assignee: A. Schild S.A., Switzerland

[22] Filed: Oct. 20, 1975

[21] Appl. No.: 624,003

[30] Foreign Application Priority Data

Nov. 1, 1974 Switzerland ..... 14689/74

[52] U.S. Cl. ..... 58/85.5; 58/58; 58/86; 58/63; 58/80

[51] Int. Cl.[2] ..... G04B 27/08

[58] Field of Search ..... 58/73, 80, 85.5, 63, 58/58, 86

[56] References Cited

UNITED STATES PATENTS

| | | | |
|---|---|---|---|
| 3,131,531 | 5/1964 | Stamm | 58/73 |
| 3,470,687 | 10/1969 | Ono et al. | 58/58 |
| 3,470,688 | 10/1969 | Miyasaka | 58/58 |
| 3,797,226 | 3/1974 | Inoki et al. | 58/85.5 X |

*Primary Examiner*—Ulysses Weldon

*Attorney, Agent, or Firm*—Stevens, Davis, Miller & Mosher

[57] ABSTRACT

This invention relates to a winding and setting mechanism for watch movements having a frame, the mechanism comprising a minute-wheel, a ratchet-wheel, a rotating control stem adapted to effect a movement of translation between at least two axial positions of setting and winding, respectively, a setting-lever pivotable upon the movement of translation of the control stem, a setting-wheel adapted to drive the minute-wheel when the stem is in the setting position, and a crown-wheel slidingly mounted for engagement with or disengagement from the ratchet-wheel according to the direction of rotation of the stem when the latter is in the winding position.

11 Claims, 4 Drawing Figures

WINDING AND SETTING MECHANISM FOR WATCH MOVEMENTS

BACKGROUND OF THE INVENTION

The conventional winding and setting mechanisms comprise a set of two levers, the setting-lever and the yoke, acted upon by springs, and a clutch-wheel mounted on a square of the stem and actuated by the yoke. Owing to the Breguet toothings provided on the inner face of the winding-pinion and on the outer face of the clutch-wheel, this arrangement allows the ratchet-wheel to be rotated in a single direction when the winding-stem is rotated back and forth in winding position. In addition, when the stem is pulled out into its outermost position, it becomes coupled to the setting-wheel via the clutch-wheel. These conventional mechanisms proved their worth for many years, but with the development of watches equipped with calendars or other devices which needed to be operated by hand under certain circumstances, it became necessary to modify them in order to have them perform new control functions obtained, for example, in an intermediate position of the stem.

Moreover, the tendency towards simplification of manufacturing and fitting operations has militated against the use of springs made of fine wire for causing the yoke to function and against the machining of Breguet toothings on the clutch-wheel and winding-pinion, above all in the case of mechanisms capable of performing other functions besides winding and setting.

It is an object of this invention to provide a winding and setting mechanism which does not comprise any parts having Breguet toothings nor any spring-wire, which lends itself to efficient manufacture and fitting, and which can, moreover, be used not only for performing the two operations of winding and setting but also for carrying out other operations in addition.

To this end, the winding and setting mechanism according to the present invention further comprises a transmission-pinion integral in rotation with the stem but held in a fixed axial position and in permanent engagement with the crown-wheel and the setting-wheel, a bolting device controlled by the setting-lever for keeping the crown-wheel disengaged from the ratchet-wheel when the stem is in the setting position, and a connecting element controlled by the stem for uncoupling the setting-wheel from the minute-wheel when the stem is in the winding position.

Figure 1:
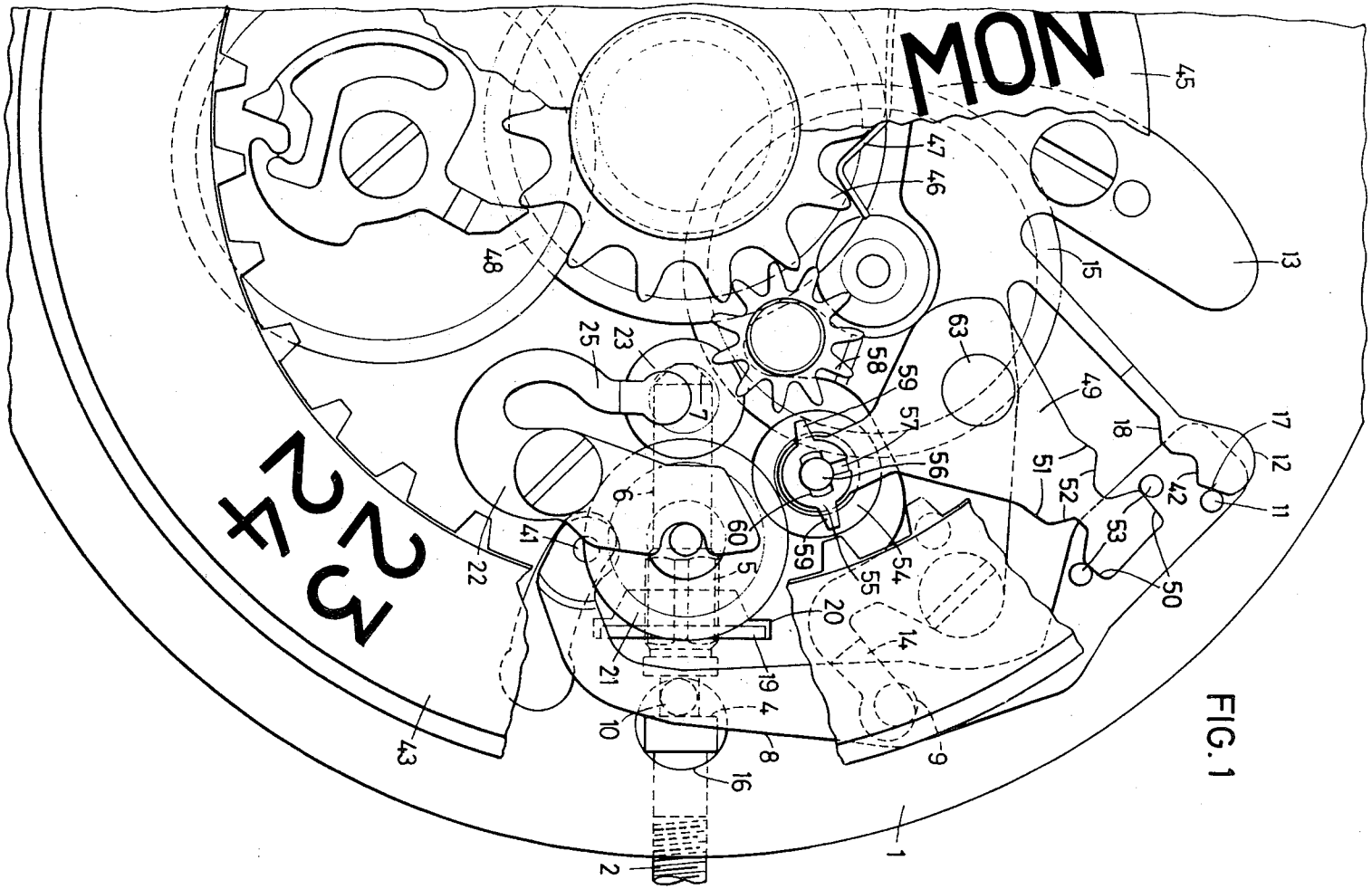
Figure 2:
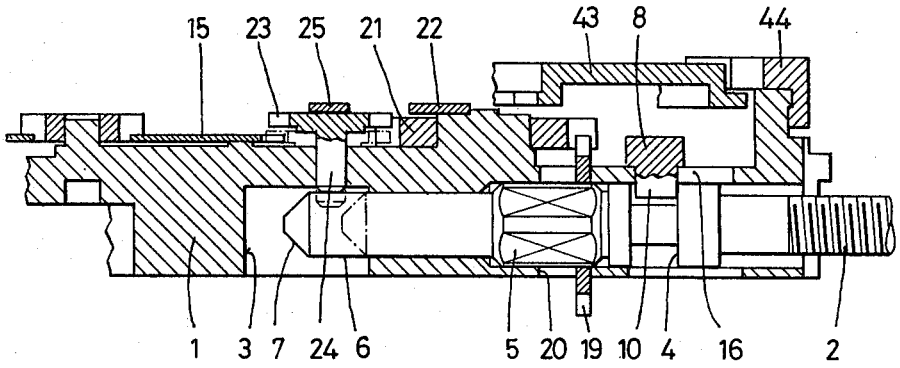
Figure 3:
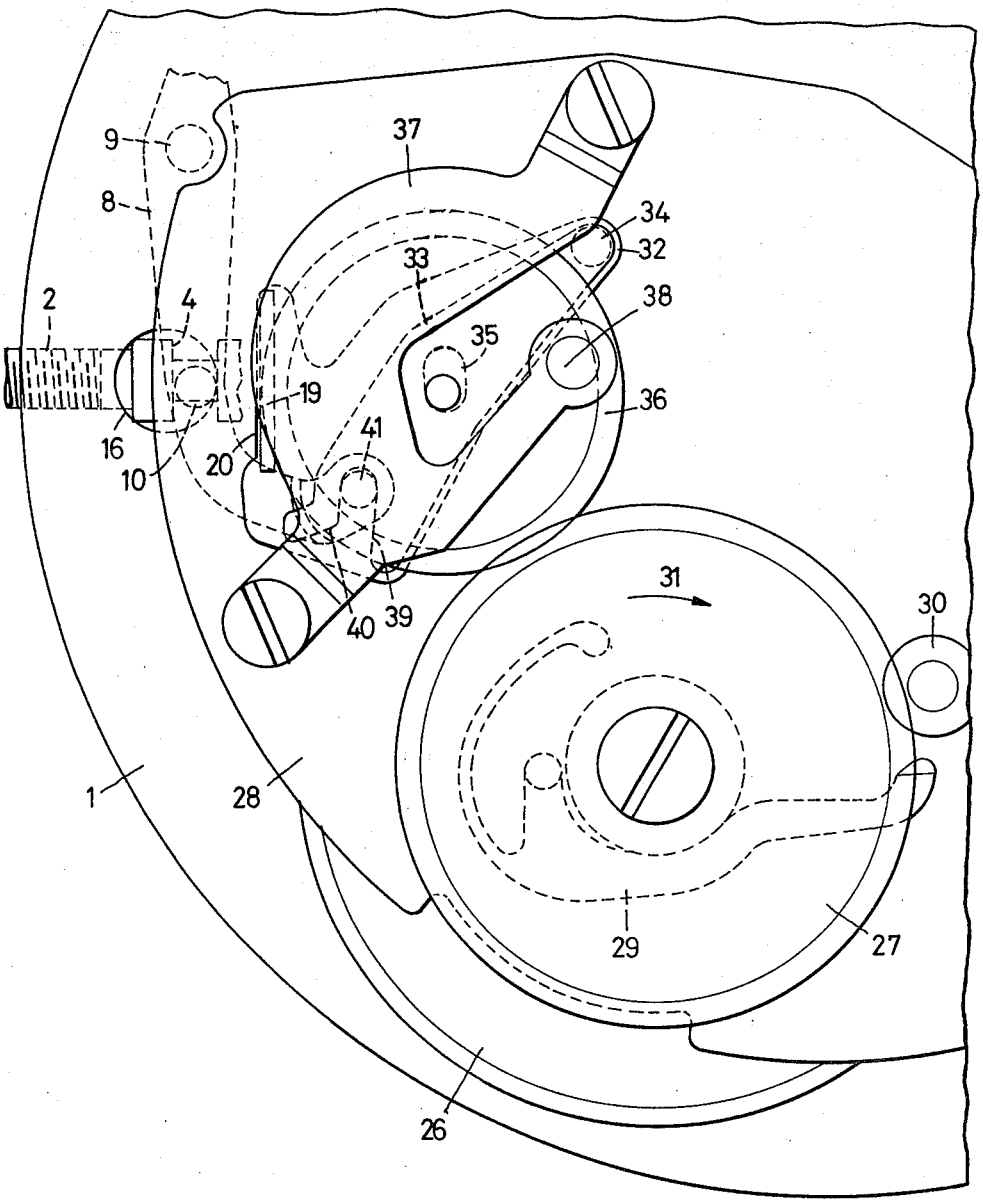
Figure 4:
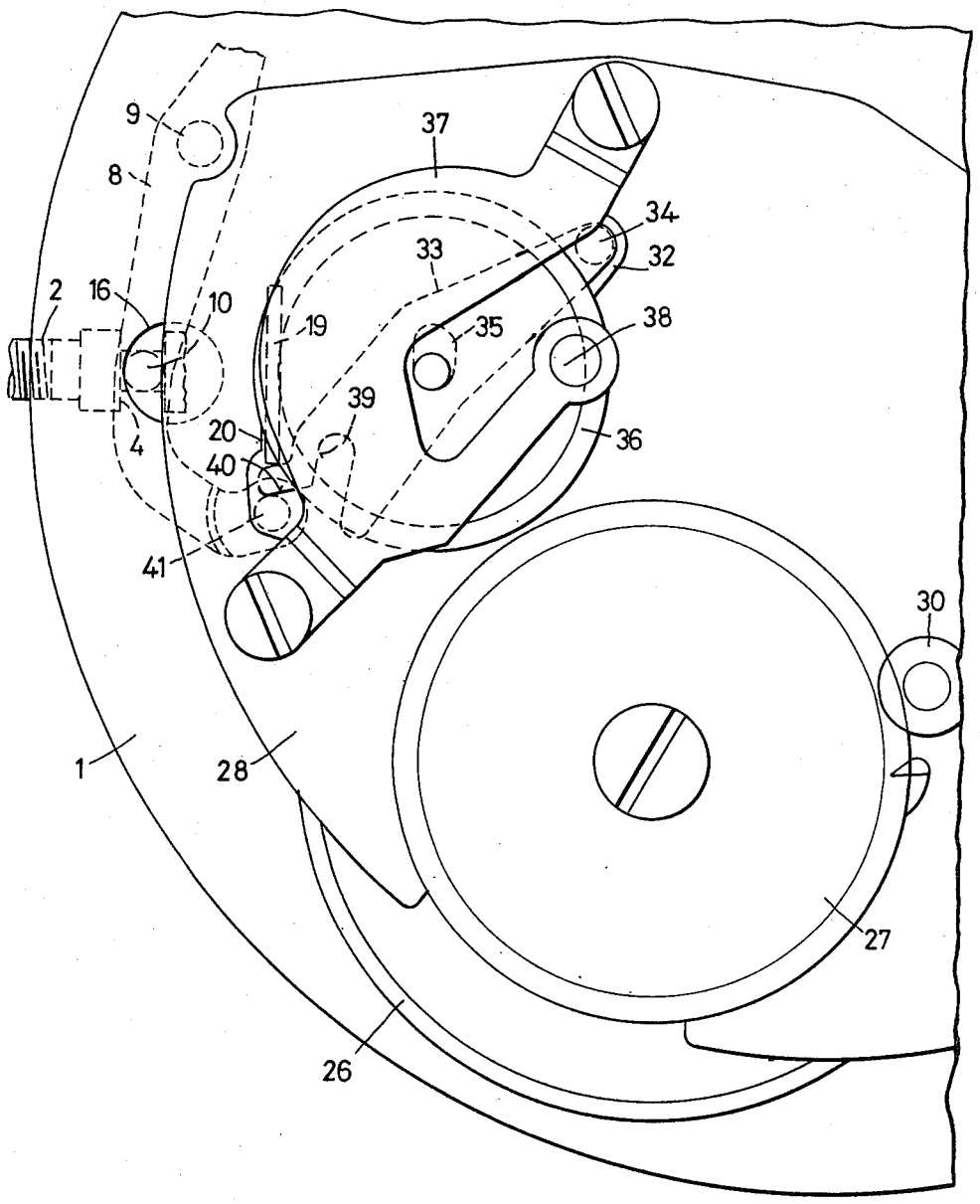

A preferred embodiment of the invention will now be described in detail with reference to the accompanying drawings, in which:

FIG. 1 is a top plan view of a calendar-watch movement equipped with this embodiment, FIG. 2 is a sectional view, taken on the axis of the stem, of certain elements shown in FIG. 1, FIG. 3 is an inverted plan view of the same movement, and FIG. 4 is a plan view analogous to that of FIG. 3 but showing the mechanism in another position.

First the important elements of the movement illustrated in FIG. 1 will be described as they appear from the dial side, but without taking into account the calendar members. FIGS. 1 and 2 show a circular plate 1 of the movement having various recesses in its outer and inner faces. A winding-stem 2 is engaged in a radial bore extending into the plate 1 from the outside and opening out into a recess 3 on the inner face thereof.

The stem 2 comprises a groove 4, followed towards the inside by a square 5, then a pivot-shank 6 ending in a frustoconical tip 7. The stem 2 cooperates with a setting-lever 8 which is mounted on the plate 1, pivots on a post 9, and comprises a stud 10 engaged in the groove 4 and, on the other side of the post 9, a block 11 which cooperates with a head 12 of a setting-lever spring 13. The spring 13 is a blanked plate secured to the plate 1 by two screws and two guide-feet and provided with a resilient tongue 14 which holds the setting-lever 8 in place on the plate 1. It also covers and holds in place a minute-wheel 15. As may be seen in FIG. 2, the stud 10 of the setting-lever 8 passes through a circular banking hole 16 made in the bottom of a recess in the plate 1. The hole 16 determines the outer and inner positions of the stem 2, for in each of these positions, the stud 10 is pressed against a portion of the periphery of the hole 16 by an incline 17 or 18 of the head 12.

A transmission-pinion 19 having a square hole is engaged on the square 5 of the stem 2. It passes through an aperture 20 punched in the plate 1 so as to be held in place in the radial direction of the movement by the aperture 20. On the dial side of the movement, the transmission-pinion 19 is engaged with a setting-wheel 21 which pivots on a collet disposed in the upper face of the plate 1 and is held in place by a retaining plate 22 secured with a screw. The setting-wheel 21 is situated on the same level as the minute-wheel 15, but it is thicker than the wheel 15. The coupling between the wheels 15 and 21 is effected by an intermediate setting-wheel 23 which is cut in one piece with an arbor 24 engaged in a hole in the plate 1. At the bottom of its pivot-hole, the arbor 24 extends into the recess 3. The setting-wheel 23 is pressed towards the plate 1 by a resilient tongue 25 blanked in one piece with the retaining plate 22. In the normal position of the stem 2, i.e., in the winding position, the arbor 24 rests on the pivot-shank 6 so that the setting-wheel 23 remains disengaged from the minute-wheel 15 while remaining engaged with the setting-wheel 21. When the stem 2 is pulled out into the setting position, the conical tip 7 assumes the position shown in dot-dash lines in FIG. 2, and the intermediate setting-wheel 23 can rest against the plate 1, as may also be seen in dot-dash lines in FIG. 2. It then couples the setting-wheel 21 to the minute-wheel 15. When the stem 2 is restored to winding position, the setting-wheel 23 is raised and resumes the position shown in FIG. 1.

The parts which perform the winding function are shown in FIGS. 3 and 4. In these figures, the movement is seen from the bridge side. A barrel 26 is disposed within the frame, while a ratchet-wheel 27 is mounted on the outer face of a bridge 28. A part 29 acts as an oscillating weight and as a weight-spring, locking the ratchet-wheel 27 in the unwinding direction. A ratchet-wheel driving pinion 30 is the last member of the automatic-winding train. It drives the ratchet-wheel 27 normally in the direction indicated by an arrow 31, showing the direction of winding the mainspring.

In the outer face of the bridge 28 is a substantially triangular recess 32 in which there is fitted a lever 33, one end of which pivots on a post 34 engaged in a hole in the bridge 28. The lever 33 comprises an elongated opening 34 in which a stud projecting from the center of a crown-wheel 36 is engaged. The crown-wheel 36 is permanently engaged with the pinion 19. It rests on the bridge 28 and is held in place by a plate 37 screwed to the bridge 28 on either side of the crown-wheel 36. The plate 37 is blanked with a tongue 38, the free end of which presses on the periphery of the crown-wheel 36 at a point directly opposite the point where the crown-wheel 36 meshes with the transmission-pinion 19. Since the longitudinal axis of the opening 35 is approximately perpendicular to an imaginary line joining the aforementioned meshing point of the crown-wheel 36 and the friction point formed by the end of the tongue 38, the crown-wheel 36 can move laterally, as will be seen further on.

At the end of the lever 33 opposite the pivot-post 34 are a slot 39 and an incline 40 which are intended to cooperate with a block 41 secured to the end of a bent arm of the setting-lever 8. This arm extends beyond the stud 10 and passes completely through the movement, through openings in the plate 1 and in the bridge 28. Upon comparing FIGS. 3 and 4, it will be understood that the lever 33 is controlled by the setting-lever 8 and performs a dual function: firstly, it guides the crown-wheel 36 so as to enable it alternately to engage with and disengage from the ratchet-wheel 27 during the back-and-forth rotation of the stem 2 in the winding position, and secondly, it keeps the crown-wheel 36 disengaged from the ratchet-wheel 27 when the stem 2 is in the setting position. The first of these functions is illustrated in FIG. 3, which thus corresponds to the winding position of the stem 2. The block 41 is engaged at the back of the slot 39, and the lever 33 is thus secured in its position closest to the ratchet-wheel 27. In this position, if the transmission-pinion 19 causes the crown-wheel 36 to rotate counterclockwise, as viewed in FIG. 3, the toothings of the crown-wheel 36 and the ratchet-wheel 27 will mesh owing to the point of friction created by the tongue 38. The ratchet-wheel 27 is therefore driven in the direction indicated by the arrow 31. If the crown-wheel 36 is caused to rotate in the other direction, its toothing will immediately be disengaged, for it pivots about the point of friction, and its stud moves to the other end of the opening 35.

If, when the mechanism is in the position shown in FIG. 3, it is the pinion 30 which actuates the ratchet-wheel 27 in the direction of the arrow 31, the crown-wheel 36 is pushed away by the teeth of the ratchet-wheel 27 and disengages from that toothing. As a result, no part of the mechanism is actuated at the time of the automatic-winding operation; this considerably increases the efficiency of this winding mechanism and, consequently, the effectiveness of the oscillating weight.

FIG. 4 illustrates the position of the mechanism during setting of the hands. The stem 2 having been pulled out, the block 41 of the setting-lever 8 has moved out of the slot 39 and along the incline 40, causing the lever 33 to rock and driving the crown-wheel 36. Thus the latter is bolted in a position where it is disengaged from the ratchet-wheel 27, so that the rotation of the stem 2 has no effect on the winding. It has previously been seen how, in this position, the transmission-pinion 19 drives the minute-wheel 15 via the setting-wheel 21 and the intermediate setting-wheel 23.

All the conventional functions of a winding and setting mechanism are therefore performed by the mechanism described, which comprises a minimum of parts, without any Breguet toothing and without any spring other than the resilient tongues 38, 25, 14, and 12. Since these tongues are blanked with the parts which bear them, their fabrication and fitting present no difficulty.

An additional advantage of the mechanism described is that it may be supplemented by an auxiliary mechanism comprising a minimal number of parts in order to perform still other control functions, e.g., to control a calendar. Thus, returning now to FIG. 1, the head 12 of the setting-lever spring 13 comprises, between the inclines 17 and 18, a notch 42 in which the block 11 may stop and which determines an intermediate position of the setting-lever 8 and of the stem 2. In this intermediate position, the block 41 is situated at the mouth of the slot 39 but still keeps the lever 33 in the position shown in FIG. 4, while as may be seen in FIG. 2, the pivot-shank 6 of the stem 2 is still under the arbor 24 of the setting-wheel 23, so that the minute-wheel 15 is not driven when the stem 2 is rotated.

The intermediate position of the stem 2 allows for the control of a date-ring 43, having a 31-tooth inner toothing, mounted on the plate 1, and held in place by a retaining-ring 44 (FIG. 2), as well as of a day-indicator 45 which pivots at the center of the movement and has a 14-tooth star 46 locked normally by a jumper 47. The date-ring 43 and the star 46 are disposed above the minute-wheel 15. Beneath the star 46 is an hour-wheel 48 engaged with the pinion of the minute-wheel 15.

For the purpose of correcting the calendar, the mechanism shown in the drawing comprises a correction lever 49 which is controlled by the setting-lever 8. The lever 49 is a bent lever which pivots on a post 63 integral with the rigid portion of the setting-lever spring 13. One of the arms of the lever 49 extends beneath the date-ring 43 and over the setting-lever 8. It is blanked with two pairs of parallel locking edges 50 and 51, separated by two notches 52 disposed opposite one another. Fixed on the setting-lever 8 are two pins 53, spaced from one another by a distance equal to that between the locking edges 50 and between the edges 51. In the two end positions of the stem 2 and the setting-lever 8, the lever 49 is locked by the pins 53, whereas in the intermediate position, the pins 53 are situated level with the notches 52, and the lever 49 is able to pivot about the post 63 to an extend determined by the distance between the bottoms of the two notches 52.

The other arm of the lever 49 carries a control assembly comprising a corrector pinion 54 situated under the lever 49 and engaged with the setting-wheel 21, an arbor 56 having a disc-shaped head, a date-corrector 55 having two diametrically opposed fingers 59, and a cambered spring-plate 57 providing a certain amount of friction between the lever 49 and the control assembly (54, 55, 56).

The date-corrector 55 is a plate blanked with a laterally-slotted elongated opening 60. The slot gives the corrector-plate 55 a certain elasticity and ensures its snug fit on a cylindrical bearing surface of the arbor 56, which is driven into the central opening of the pinion 54.

In the intermediate position of the stem 2, a clockwise or counterclockwise rotation of the setting-wheel 21, as viewed in FIG. 1, first causes a displacement of the lever 49, owing to the friction of the plate 57. The pinion 54 remains engaged with the setting-wheel 21, but the correction fingers 59 can actuate either the date-ring 43 or an intermediate pinion 58 which in turn actuates the day-star 46. The module of the pinion 58 is half that of the star 46, this arrangement being chosen to facilitate the meshing of the two correction fingers 59 with the pinion 58.

Instead of controlling a date-ring and a day-star, the lever 49 might equally well perform other functions. It might, for instance, control an alarm-hand and a date-ring, or still other elements.

What is claimed is:

1. A winding and setting mechanism for watch movements having a frame, said mechanism comprising a minute-wheel, a ratchet-wheel, a rotating control stem adapted to effect a movement of translation between at least two axial positions of setting and winding, respectively, a setting-lever pivotable upon said movement of translation, a setting-wheel adapted to drive said minute-wheel when said stem is in said setting position, and a crown-wheel slidingly mounted for engagement with or disengagement from said ratchet-wheel according to the direction of rotation of said stem when said stem is in said winding position, further comprising a transmission-pinion integral in rotation with said stem but held in a fixed axial position and in permanent engagement with said crown-wheel and said setting-wheel, a bolting device controlled by said setting-lever for keeping said crown-wheel disengaged from said ratchet-wheel when said stem is in said setting position, and a connecting element controlled by said stem for uncoupling said setting-wheel from said minute-wheel when said stem is in said winding position.

2. A mechanism in accordance with claim 1, further comprising a stud projecting from said crown-wheel, wherein said bolting device comprises a further lever having an elongated opening therein, said stud being engaged in said elongated opening, said further lever being controlled by said setting-lever and, when said stem is in said setting position, being so positioned that said stud is held by an end of said elongated opening in such a position that said crown-wheel is disengaged from said ratchet-wheel.

3. A mechanism in accordance with claim 2, wherein said setting-lever is disposed on an element of said frame and comprises a bent arm passing through said frame and cooperating with said further lever, said further lever being mounted on another element of said frame.

4. A mechanism in accordance with claim 3, further comprising a cover-plate for holding said crown-wheel in place, and wherein said other element of said frame comprises a recess in which said further lever is disposed.

5. A mechanism in accordance with claim 4, wherein said cover-plate comprises a resilient tongue pressing upon the periphery of said crown-wheel at a point directly opposite the point of said engagement of said transmission-pinion with said crown-wheel, said elongated opening being disposed substantially perpendicular to an imaginary line between said points.

6. A mechanism in accordance with claim 1, wherein said connecting element is an intermediate setting-wheel adapted for engagement with said setting-wheel and with said minute-wheel, further comprising a resilient holding tongue pressing upon said intermediate setting-wheel, said intermediate setting-wheel being axially displaceable by said stem against the pressure of said tongue when said stem effects said movement of translation towards or away from said setting position.

7. A mechanism in accordance with claim 1, wherein said setting-lever comprises a stud and said frame comprises a circular hole, said setting-lever being hinged on said stem via said stud, said stud passing through said hole, and the periphery of said hole determining inner and outer end positions of said stem.

8. A mechanism in accordance with claim 1, wherein said stem is adapted to occupy an intermediate axial position between said winding position and said setting position, further comprising a control lever and a control assembly borne by said control lever and permanently engaged with said setting-wheel, said control lever being coupled to said setting-lever in such a way that said setting-lever either locks said control lever to render it inoperative or leaves said control lever free to effect a pivoting movement of limited amplitude according to the position occupied by said stem.

9. A mechanism in accordance with claim 8, wherein said connecting element is an intermediate setting-wheel adapted for engagement with said setting-wheel and with said minute-wheel, further comprising a resilient holding tongue pressing upon said intermediate setting-wheel, said intermediate setting-wheel being axially displaceable by said stem against the pressure of said tongue when said stem effects said movement of translation toward or away from said setting position, and said intermediate setting-wheel being held by said stem in a position in which it is disengaged from said minute-wheel when said stem is in said intermediate position.

10. A mechanism in accordance with claim 8, further comprising one or more calendar indicator members, wherein said control assembly comprises a pinion engaged with said setting-wheel and a corrector member friction-coupled to said pinion and provided with radial fingers for actuating said one or more calendar indicator members.

11. A mechanism in accordance with claim 10, further comprising a friction member disposed between said control lever and said control assembly for causing said control lever to pivot upon each reversal of the direction of rotation of said stem when said stem is in said intermediate axial position.

* * * * *